US009878866B2

(12) United States Patent
Mashima et al.

(10) Patent No.: US 9,878,866 B2
(45) Date of Patent: Jan. 30, 2018

(54) RECORDING DEVICE AND CONVEYANCE DEVICE

(71) Applicant: SEIKO EPSON CORPORATION, Tokyo (JP)

(72) Inventors: Akira Mashima, Nagano (JP); Seijun Horie, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 14/223,213

(22) Filed: Mar. 24, 2014

(65) Prior Publication Data

US 2014/0291375 A1 Oct. 2, 2014

(30) Foreign Application Priority Data

Mar. 29, 2013 (JP) ..... 2013-071623

(51) Int. Cl.
*B65H 20/02* (2006.01)

(52) U.S. Cl.
CPC ... *B65H 20/02* (2013.01); *B65H 2301/44318* (2013.01); *B65H 2404/147* (2013.01); *B65H 2404/1521* (2013.01); *B65H 2801/06* (2013.01); *B65H 2801/09* (2013.01); *B65H 2801/12* (2013.01); *B65H 2801/15* (2013.01); *B65H 2801/36* (2013.01)

(58) Field of Classification Search
CPC ..... B65H 20/02; B65H 2301/44318; B65H 2404/144; B65H 2404/1521
See application file for complete search history.

(56) References Cited

U.S. PATENT DOCUMENTS 4,268,163 A * 5/1981 Doi ..... B65H 20/04 271/274
5,494,364 A 2/1996 Murakami et al.
(Continued)

FOREIGN PATENT DOCUMENTS

JP 60-148756 U 10/1985
JP 61-257852 A 11/1986
(Continued)

OTHER PUBLICATIONS

The extended European Search Report for European Application No. 14162093.0, dated Jul. 15, 2014.

*Primary Examiner* — Michael C McCullough
(74) *Attorney, Agent, or Firm* — Global IP Counselors, LLP

(57) ABSTRACT

A recording device includes a recording unit that performs recording on a recording medium with the recording medium being stored in a rolled state and unrolled from one end. The recording device includes a pair of abutting rollers, a support roller and a movable mechanism. The abutting rollers face each other, and convey the recording medium while the recording medium is nipped between the abutting rollers. The support roller is arranged on a downstream side of the abutting rollers in a conveyance path of the recording medium. The support roller abuts the recording medium to support the recording medium. The movable mechanism changes a position of at least one of the abutting rollers to switch between an abutting state in which the other of the abutting rollers abuts the recording medium and a released state in which the other of the abutting rollers does not abut the recording medium.

5 Claims, 6 Drawing Sheets

(56) References Cited

U.S. PATENT DOCUMENTS

| | | | | |
|---|---|---|---|---|
| 6,131,898 | A | 10/2000 | Hiroi et al. | |
| 6,908,189 | B2 * | 6/2005 | Miyamoto | B41J 11/0005 347/101 |
| 9,180,690 | B2 * | 11/2015 | Moore | B41J 11/0005 |
| 2004/0017456 | A1 | 1/2004 | Obertegger et al. | |
| 2012/0201590 | A1 * | 8/2012 | Moore | B41J 11/0005 400/613.3 |

FOREIGN PATENT DOCUMENTS

| | | | |
|---|---|---|---|
| JP | 01-173760 | U | 12/1989 |
| JP | 05-169744 | A | 7/1993 |
| JP | 10-167489 | A | 6/1998 |
| JP | 2012-000908 | A | 1/2012 |
| WO | 02/22362 | A2 | 3/2002 |

* cited by examiner

RECORDING DEVICE AND CONVEYANCE DEVICE

CROSS-REFERENCE TO RELATED APPLICATIONS

This application claims priority to Japanese Patent Application No. 2013-071623 filed on Mar. 29, 2013. The entire disclosure of Japanese Patent Application No. 2013-071623 is hereby incorporated herein by reference.

BACKGROUND

Technical Field

The present invention relates to a device for performing processing on a medium supported in a state rolled in roll form while pulling one end.

Related Art

In the past, with the recording device of a printing device or the like, the recording medium was conveyed up to the recording unit, and after recording was performed on the recording medium by the recording unit, the medium was ejected to outside the device. For example, a device is disclosed that is equipped with a roller that takes out a cut sheet from a housing unit, and conveys it. With this device, the cut sheet is taken out from the housing unit by rotating the roller while pressing it on the top surface of the cut sheet housed in the housing unit. Then, the conveyance means receives the cut sheet that followed the rotation of the roller and was conveyed, and conveys it (for example, see Japanese Unexamined Patent Publication No. H10-167489).

SUMMARY

When the medium is supported in a roll form, in contrast to when conveying cut sheets, it is necessary to convey the rolled up medium while pulling it. Because of that, the device is equipped with a pair of rollers that respectively abuts the medium, and conveyance of the medium is performed by this pair of rollers abutting above and below the medium. Because of that, the constitution is such that the friction force becomes stronger when the pair of rollers is abutting the medium.

However, in a state with contact between the pair of rollers and the medium being continuous, when processing is implemented on this medium, there are cases when friction force between the roller and the medium is strong, and processing is performed with the medium left in an unreasonable orientation, or in some cases, when the medium is damaged.

The present invention was created considering the problems noted above, and an object is to provide a recording device and conveyance device capable of implementing suitable processing on a medium supported in a state rolled into roll form.

A recording device according to one aspect includes a recording unit configured and arranged to perform recording on a recording medium with the recording medium being stored in a rolled state and unrolled from one end. The recording device includes a pair of abutting rollers, a support roller and a movable mechanism. The pair of abutting rollers face each other, and configured and arranged to convey the recording medium while the recording medium is nipped between the pair of abutting rollers. The support roller is arranged on a downstream side of the pair of abutting rollers in a conveyance path along which the recording medium is conveyed. The support roller is configured and arranged to abut the recording medium to support the recording medium. The movable mechanism is configured and arranged to change a position of at least one of the pair of abutting rollers to switch between an abutting state in which the other of the pair of abutting rollers abuts the recording medium and a released state in which the other of the pair of abutting rollers does not abut the recording medium.

Here, the recording medium can be any item as long as it is an item that can be recorded with a recording material such as ink or the like.

Also, the recording unit can be any well-known item as long as it can perform recording on the recording medium.

Also, the movable mechanism can be any item for which abutting of any of the conveyance rollers on the recording medium can be released by changing the position of at least one of the abutting rollers, and it is also possible to change the position of all the abutting rollers.

With the aspect as noted above, during conveyance of the recording medium by the pair of abutting rollers, the relative position of the pair of abutting rollers is maintained, and they are made to abut the recording medium. Meanwhile, when the moving mechanism changes the position of at least one of the pair of abutting rollers, and the abutting by the pair of abutting rollers is released, the recording medium is supported on the support roller. Here, the recording medium is used in a state with one end supported to be able to rotate and the other end pulled and unrolled, so by supporting the recording medium using the support roller on the conveyance path, the position of the recording medium within the conveyance path changes, and abutment with one of the pair of abutting rollers is eased.

Because of that, since the abutment with the abutting roller is eased, it is possible to perform recording of the recording medium without the recording medium being in an unreasonable orientation, or having damage occur.

It is also possible to have a constitution having a pair of nipping rollers arranged on the downstream side of the pair of abutting rollers in the conveyance path, and the pair of nipping rollers is configured and arranged to nip the recording medium therebetween to convey the recording medium.

With this arrangement as noted above, by the pair of nipping rollers nipping the recording medium and conveying it, the recording medium is reliably aligned, and it is possible to perform recording with good precision.

It is also possible to have a constitution wherein the movable mechanism is configured and arranged to switch to the released state when the pair of nipping rollers starts conveying the recording medium.

With this arrangement as noted above, it is possible to suppress forcing of an unreasonable orientation or unreasonable force being applied to the recording medium due to interference between the nipping of the pair of nipping rollers and the abutting of the pair of abutting rollers.

Furthermore, it is also possible to have a constitution wherein the movable mechanism is configured and arranged to switch to the released state during recording by the recording unit on the recording medium.

With this arrangement, it is possible to ease the effect by the pair of abutting rollers during recording.

It is also possible to have a constitution that further includes an additional support roller, and the recording medium is stretched across the support roller and the additional support roller in the released state.

With this arrangement as noted above, when abutting of the pair of abutting rollers is released, the recording medium is stretched (bridged) across the first support roller and the second support roller, so the recording medium is positioned separated from the pair of abutting rollers. As a result, it is possible to suppress the occurrence of friction that occurs with abutting of the pair of abutting rollers on the recording medium.

Also, the present invention can also be applied to a conveyance device for conveying a sheet material to be conveyed supported in a rolled state.

BRIEF DESCRIPTION OF THE DRAWINGS

Referring now to the attached drawings which form a part of this original disclosure.

DETAILED DESCRIPTION OF EXEMPLARY EMBODIMENTS

Hereafter, we will describe embodiments of the present invention in the following sequence: 1. First Embodiment; 2. Second Embodiment; and 3. Other Embodiments.

1. First Embodiment

Figure 1A:
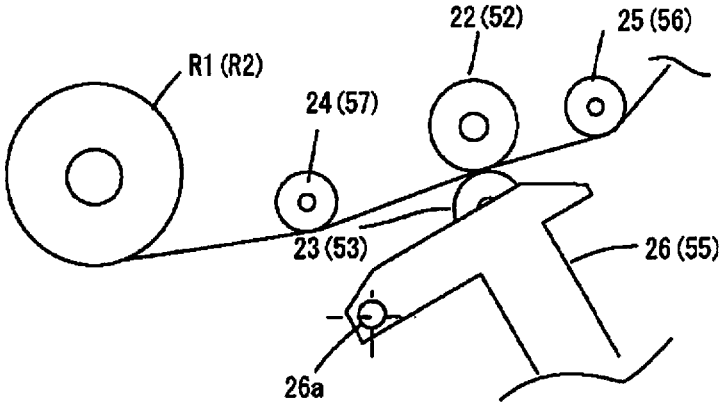
FIGS. 1A and 1B are side views showing an example of parts of a recording device for describing an example of the embodiment.
Figure 1B:
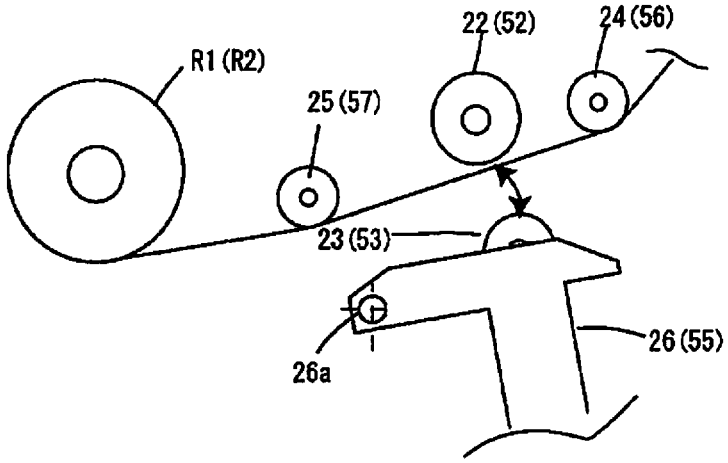
Figure 2:
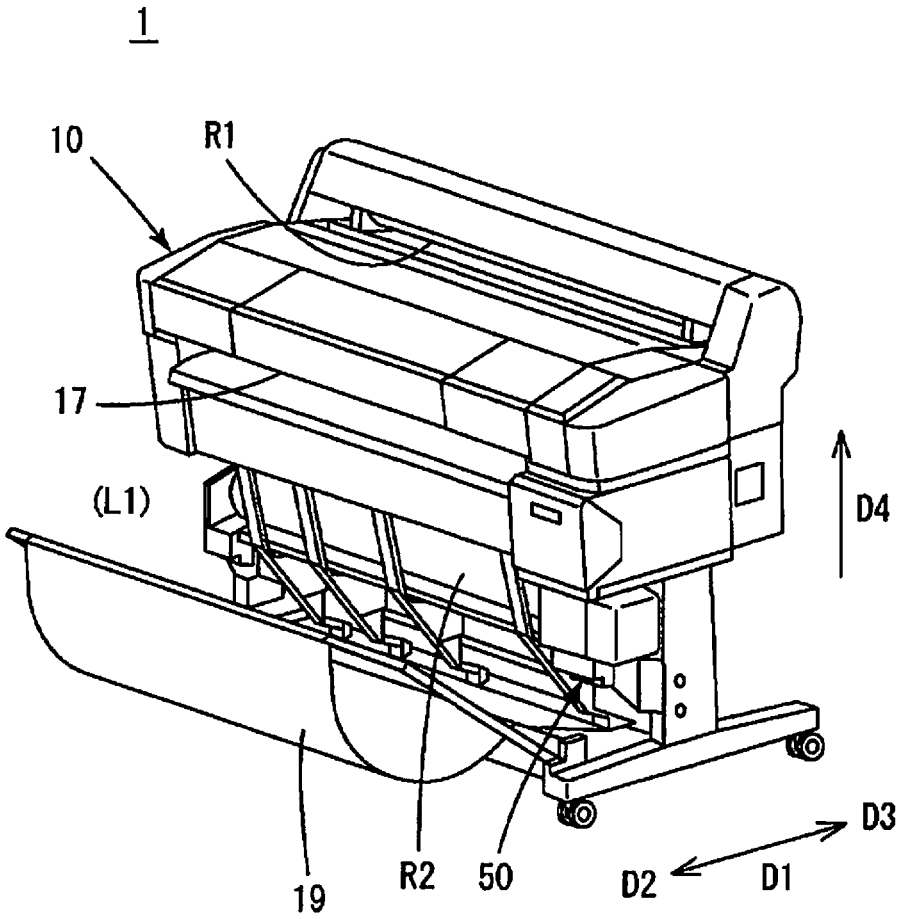
FIG. 2 is a perspective view showing the external view of a large size inkjet printer as an example of a recording device.
Figure 3:
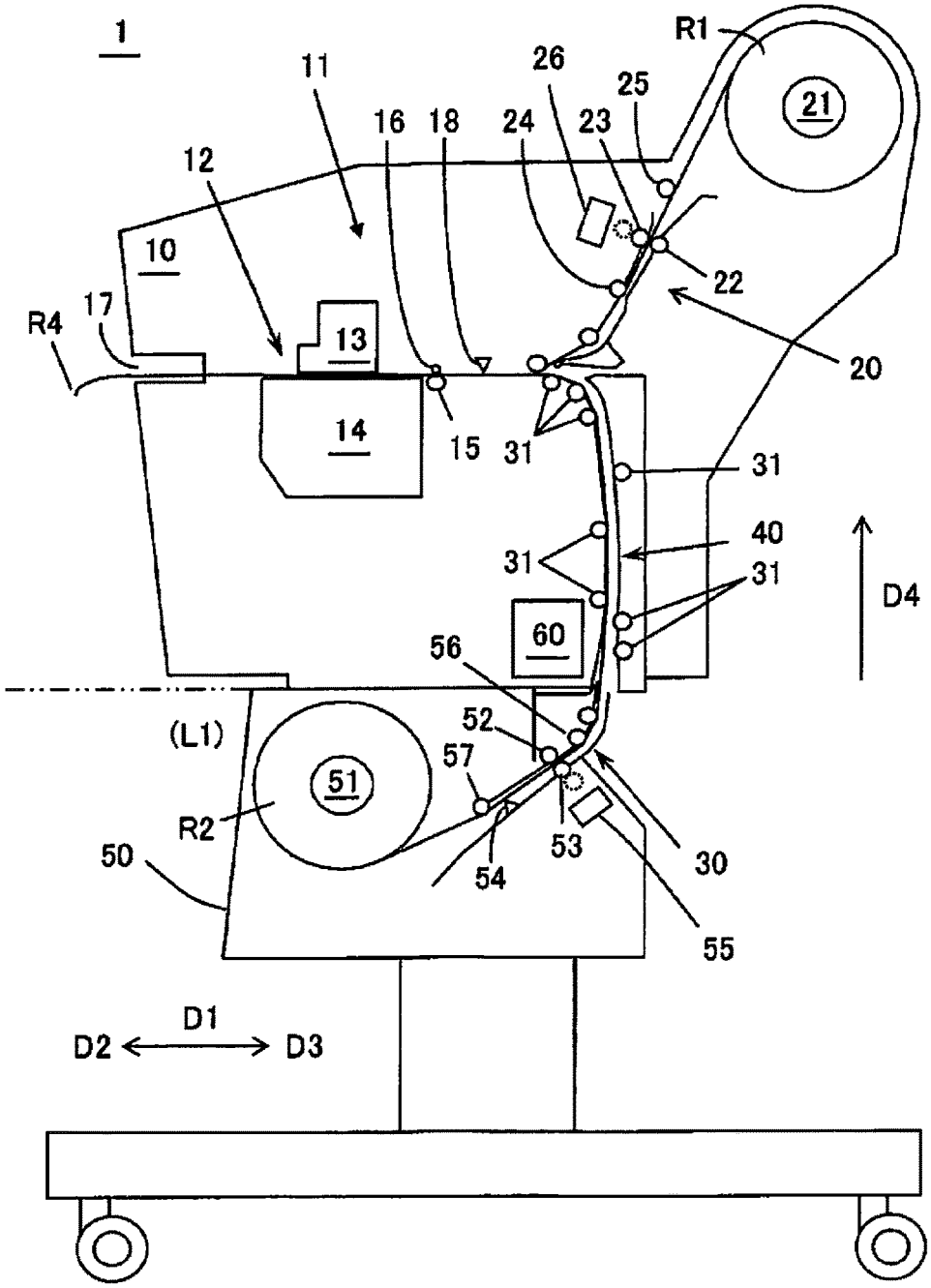
FIG. 3 is a vertical cross section diagram showing the recording device with the stacker omitted.
Figure 4:
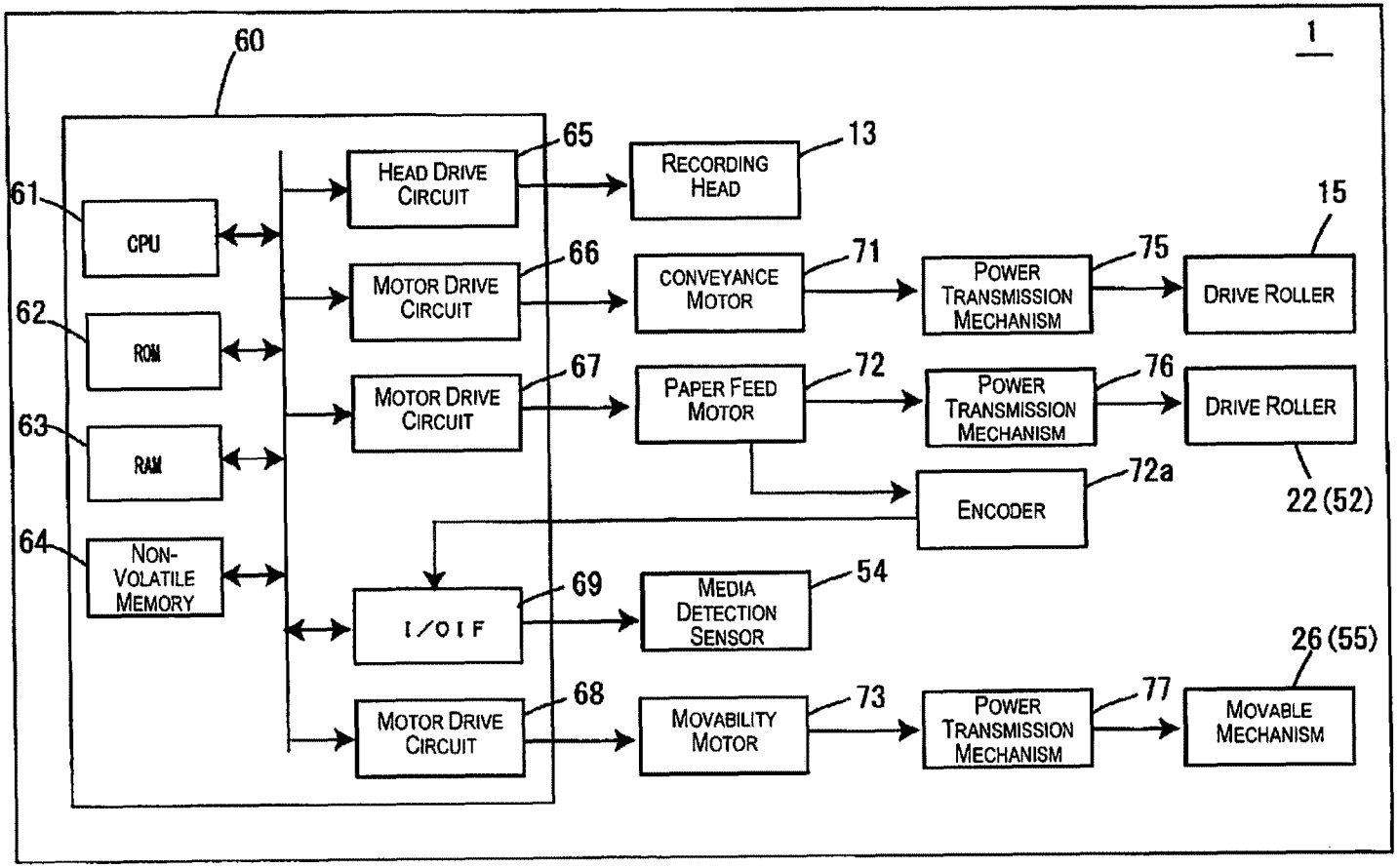
FIG. 4 is a block diagram for describing the constitution of the recording device.

FIG. 1 is a side view showing an example of the key parts of the recording device for describing this technology. Also, FIG. 2 is a perspective view showing the external view of a large scale inkjet printer as an example of the recording device. Then, FIG. 3 is a vertical cross section diagram showing the recording device with the stacker 19 omitted. Furthermore, FIG. 4 is a block diagram for describing the constitution of the recording device.

With this first embodiment, the recording device is realized as an inkjet printer that performs recording on roll paper (recording medium, medium to be conveyed) R1 and R2.

As shown in FIG. 2, the recording device 1 is equipped with a case 10, and a paper feed unit 50 provided to be able to slide in sliding direction D1 in relation to this case 10. Also, the recording device 1 is able to do printing (perform recording) while switching between the device top part interior first roll paper R1 and the device bottom part second roll paper R2. Also, the roll paper after printing, after being cut by a cutter 18, is ejected through an ejection unit 17 (R4 in FIG. 3), and is stacked in the stacker 19.

In the drawing described above, the code D1 shows the slide direction of the paper feed unit 50 in relation to the case 10. The code D2 shows the pulling direction of the paper feed unit 50 from the housed position L1 toward the pulling position. Also, the code D3 shows the housing direction of the paper feed unit 40 from the pulled state toward the housed position L1. Then, the code D4 shows the height direction of the recording device 1.

The roll paper R1 and R2 is continuous paper rolled into roll form. With the roll paper R1 and R2, the outside is the printing surface. Of course, when the position of the feeding mechanism 21 and 51 is changed, it is also possible to use roll paper for which the inside is the printing surface. For the roll paper, it is possible to use rolled sheets of various materials such as paper, cloth, plastic sheets, leather or the like.

Also, as shown in FIG. 3 and the like, inside the case 10 are equipped a recording unit 12, a pair of conveyance rollers 15 and 16, a cutter 18, paths 11, 20, 30, and 40, paper feed mechanisms (21 to 26), paper feed mechanisms (51 to 57), rolling rollers 31, and a control unit 60.

The paths in which the roll paper R1 or the roll paper R2 are fed and conveyed include a conveyance path 11, a first paper feed path 20, and second paper feed paths 30 and 40. The conveyance path 11 is a path for which printing is performed on the roll paper R1 (R2). Also, the first paper feed path 20 is a path for feeding roll paper R1 to the pair of conveyance rollers 15 and 16. Also, the second paper feed paths 30 and 40 are paths that feed the roll paper R2 to the pair of conveyance rollers 15 and 16. In particular, the second paper feed path 30 is a path formed proximal to the paper feed unit 50, and the second paper feed path 40 is a path formed further to the downstream side than the second paper feed path 30.

The definition and positional relationship of the paths 11, 20, 30, and 40 are not limited to this. For example, it is also possible for a portion of the conveyance path 11 to overlap a portion of the first paper feed path 20 or the second paper feed path 40. It is also possible to form different paths between the paths.

The pair of conveyance rollers 15 and 16 and the recording unit 12 are arranged in the conveyance path 11.

The pair of conveyance rollers 15 and 16 is equipped with a drive roller 15 arranged at the lower side and a driven roller 16 arranged at the upper side. The drive roller 15 is rotated by a conveyance motor 71 described later. Also, the driven roller 16 is supported to be able to rotate, and with the drive roller 15, sandwiches the recording medium. Because of that, the driven roller 16 rotates following the roll paper R1 (R2) conveyed by the rotation of the drive roller 15.

The recording unit 12 is arranged further to the downstream side than the pair of conveyance rollers 15 and 16 in the conveyance path 11. The recording unit 12 is equipped with a recording head 13 and a platen 14 that supports the conveyed roll paper R1 and R2 from beneath. With this embodiment, the recording device 1 is described as a serial type printer for which the recording unit 12 is moved by a carriage (not illustrated) in the direction intersecting the direction in which the roll paper R1 and R2 is conveyed. However, it is also possible for the recording device 1 to be a line head type printer.

The first paper feed path 20 is equipped with a feeding mechanism 21 that supports the roll paper R1, a pair of paper feed rollers (abutting rollers) 22 and 23, and support rollers 24 and 25.

The feeding mechanism 21 has the roll paper R1 supported to be able to rotate on a roll shaft. With this embodiment, the feeding mechanism 21 does not have the power to rotate the roll paper R1, but the feeding mechanism 21 can have the power to rotate the roll paper 21.

The pair of paper feed rollers 22 and 23 is equipped with a drive roller 22 arranged at the upper side and a driven roller 23 arranged at the lower side, sandwiching the roll paper R1 fed by the first paper feed path 20. The drive roller 22 rotates by the rotation of a paper feed motor 72 described later, and feeds the roll paper R1 to the conveyance path 11. For example, the drive roller 52 is constituted by a rubber roller. Also, the driven roller 23, while together with the drive roller 22 abutting the respective surfaces facing opposite the roll paper R1, rotates following the roll paper R1 that is paper fed according to the rotation of the drive roller 22.

The movable mechanism 26 supports the driven roller 23 to be able to rotate. Also, as shown in FIG. 1A, the movable mechanism 26 switches the position of the driven roller 23 between a first position near the drive roller 22 and a second position separated from the drive roller 22 shown in FIG. 1B. When the driven roller 23 is positioned in the first position, the driven roller 23 abuts the surface of the roll paper R1. Meanwhile, when the driven roller 23 is positioned in the second position, abutting on the roll paper R1 is released.

With this first embodiment, the movable mechanism 26 swings with a fulcrum 26*a* as a reference according to driving of a movability motor 73 described later, and switches the position of the driven roller 23 between the first position and the second position. Of course, this is merely one example of the constitution of the movable mechanism 26, and it is possible to be equipped with any of various mechanisms as long as it can switch the position of the driven roller 23 between the first position and the second position.

The support rollers 24 and 25 are equipped with a first support roller 24 arranged further to the downstream side of the first paper feed path 20 than the pair of paper feed rollers 22 and 23, and a second support roller 25 arranged further to the upstream side of the first paper feed path 20 than the pair of paper feed rollers (22, 23). The first support roller 24 is supported to be able to rotate on the wall of the upper part of the first paper feed path 20, and juts slightly to the inside of the path from the inner surface of this wall. The second support roller 25 is supported to be able to rotate on the wall of the top part of the first paper feed path 20, and juts slightly to the inside of the path from the inner surface of this wall.

Also, a feeding mechanism 51 that supports the second roller paper R2 is arranged on the paper feed unit 50. Also, paper feed rollers (a pair of conveyance rollers) 52 and 53, a media detection sensor 54, a movable mechanism 55, and support rollers 56 and 57 are positioned in the second paper feed path 40.

The pair of paper feed rollers 52 and 53 is equipped with a drive roller 52 arranged at the upper side sandwiching the roll paper R2 that is fed by the second paper feed path 40, and a driven roller 53 arranged at the lower side. The driver roller 52 rotates according to the rotation of a paper feed motor 72 described later. For example, the drive roller 52 is constituted using a rubber roller.

Also, the driven roller 53, while abutting the surface facing opposite the roll paper R1 together with the drive roller 52, rotates following the roll paper R2 that is fed according to the rotation of the drive roller 52.

The movable mechanism 55 supports the driven roller 53 to be able to rotate. Also, the same as with the movable mechanism 26 of the first paper feed path 20, the movable mechanism 55 switches the position of the driven roller 53 between the first position near the drive roller 52 (FIG. 1A) and the second position separated from the drive roller 52 (FIG. 1B).

The drive roller and the driven roller constituting the pair of rollers may be arranged conversely from the positional relationship described above. It is also possible to have the movable mechanism switch the position of the drive roller. Also, it is also possible to constitute the pair of drive rollers using a pair of rollers using a drive roller instead of the driven roller. Furthermore, in addition to the drive roller and the driven roller abutting the respective surfaces sandwiching both surfaces of the roll paper, it is also possible to have the abutting position skewed in the conveyance direction.

The media detection sensor 54 detects whether or not the roll paper R2 is being supplied to the upstream side of the pair of paper feed rollers 52 and 53 in the second paper feed path 40.

The support rollers 56 and 57 are equipped with a first support roller 56 arranged further to the downstream side of the second paper feed path 40 than the pair of paper feed rollers (52, 53), and a second support roller 57 arranged further to the upstream side of the second paper feed path 40 than the pair of paper feed rollers (52, 53). The first support roller 56 is supported to be able to rotate on the wall of the top part of the second paper feed path 40, and juts slightly to the inside of the path from the inner surface of this wall. The second roller 57 is supported to be able to rotate on the wall of the top part of the second paper feed path 40, and just slightly to the inside of the path from the inner surface of this wall.

A plurality of rolling rollers 31 are arranged in the second paper feed path 30. The rolling rollers 31 support the roll paper R2 that passes through the second paper feed path 30. The rolling rollers 31 are supported to be able to rotate on the wall of the second paper feed path 30, and just slightly from the inner surface of the path wall.

As shown in FIG. 4, the control unit 60 is equipped with a CPU (Central Processing Unit) 61, a ROM (Read Only Memory) 62, a RAM (Random Access Memory) 63, a non-volatile memory 64, a head drive circuit 65, motor drive circuits 66, 67, and 68, and an I/O interface 69. A control program or data to be executed by the CPU 61 are recorded in the ROM 62. The CPU 61 controls driving of the recording device 1 comprehensively by executing the control programs or data recorded in the ROM 62 while expanding in the RAM 63.

Also, job data used with print processing is recorded in the non-volatile memory 64. For example, when the control unit 60 receives job data from an external device such as a personal computer or the like (not illustrated), this job data is temporarily recorded in the non-volatile memory 64.

The head drive circuit 65 is electrically connected to the recording head 13, and drives the recording head 13 by commands from the CPU 61. The recording head 13 is for example an inkjet recording head that sprays ink from nozzles. The recording head 13 sprays ink from nozzles and performs recording on the roll paper R1 (R2) by drive signals supplied from the head drive circuit 65.

The motor drive circuits 66, 67, and 68 are respectively connected to the movability motor 73, and drive each motor (71, 72, and 73) by commands from the CPU 61. To do that, the motor drive circuits 66, 67, and 68 function as the drivers for the motors 71, 72, and 73.

The conveyance motor 71 is connected to the conveyance drive rollers 15 and 52 via a power transmission mechanism 75. Because of that, the drive rollers 15 and 52 are rotated by driving (rotation) of the conveyance motor 71.

The paper feed motor 72 is connected to the paper feed drive roller 22 (53) via a power transmission mechanism 76. Because of that, the paper feed motor 72 rotates the driver roller 22 (53) of the pair of paper feed rollers by driving (rotation) of the paper feed motor 72.

In FIG. 4, for convenience, a constitution for which a plurality of driver rollers are connected to the power transmission mechanism 75 and 76 is described, but the invention is not limited to this.

The movability motor 73 is connected to the movable mechanism 26 (55) via a power transmission mechanism 77.

Because of that, the movable mechanism 26 (55) moves by driving (rotation) of the movability motor 73, and the position of the driver roller 23 (53) of the pair of paper feed rollers is changed.

Also, the I/O interface 69 is connected to the media detection sensor 54 and an encoder 72*a* attached to the paper feed motor 72. The media detection sensor 54 detects the presence or absence of the roll paper R2. The media detection sensor 54 is constituted by a well-known sensor such as an optical sensor or the like, for example. Also, the encoder 72*a* converts the rotation count of the paper feed motor 72 to pulse signals and outputs that. Because of that, the I/O interface 69 receives the respective output from the media detection sensor 54 and the encoder 72*a*, and is able to output that to the CPU 61.

Figure 5:
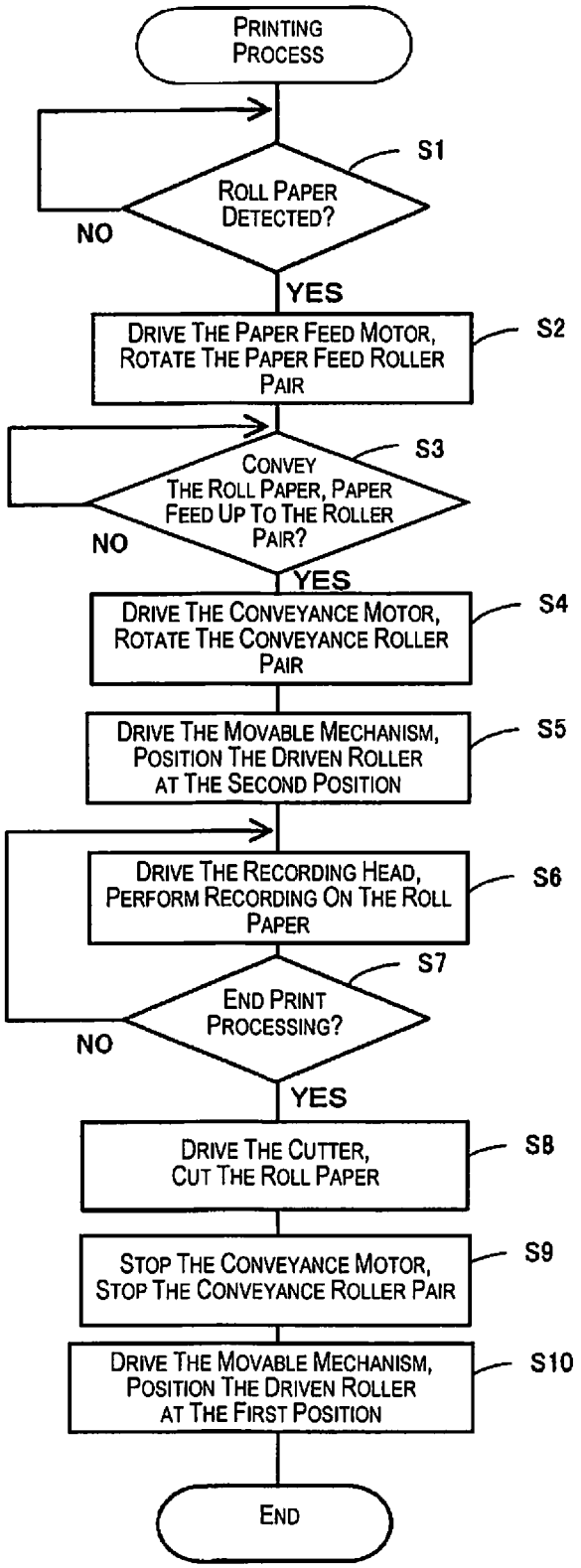
FIG. 5 is a flow chart for describing the flow of the printing process.

Next, we will describe the printing process executed by the recording device 1. With the printing process described hereafter, we will describe a printing process using the second roll paper R2. Note that the same method can also be used for the printing process using the first roll paper R1. FIG. 5 is a flow chart describing the printing process flow.

First, the user inserts the pulled tip part of the roll paper R2 from an insertion port (not shown) toward the interval between rollers of the pair of paper feed rollers 52 and 53. In this state, the movable mechanism 55 holds the position of the driven roller 53 in the first position. Specifically, the drive roller 52 and the driven roller 53 are near each other.

Then, when the media detection sensor 54 detects the roll paper R2 inserted by the user (step S1: Yes), the control unit 60 rotates the paper feed motor 72. Because of that, the drive roller 52 to which the rotation of the paper feed motor 72 is transmitted starts rotating. In this state, when the tip of the roll paper R2 reaches between the drive roller 52 and the driven roller 53, the pair of paper feed rollers 52 and 53 pull in the roll paper R2.

Then, the tip of the pulled in roll paper R2 penetrates the second paper feed path 30 in a state supported on the support rollers 56 and 57. Then, by rotation of the drive roller 52 continuing, the tip of the roll paper R2 passes through the second paper feed path 30, and reaches the conveyance path 11. Here, the paper feed of the pair of paper feed rollers 52 and 53 continues until the tip of the roll paper R2 reaches the pair of conveyance rollers 15 and 16 inside the conveyance path 11 (step S3).

As a method of detecting that the tip of the roll paper R2 has reached the pair of conveyance rollers 15 and 16, for example, the control unit 60 makes a judgment based on the rotation count detected by the encoder 72*a* connected to the paper feed motor 72. Specifically, the rotation count N1 of the paper feed motor 72 according to the paper feed distance of the fed roll paper R2 is recorded in the ROM 62. With this first embodiment, the roll paper R2 paper feed distance is the distance from the pair of paper feed rollers 52 and 53 to the conveyance rollers 15 and 16.

Also, in addition to this, it is also possible to provide a sensor that detects the roll paper R1 and R2 further to the downstream side than the pair of conveyance rollers 15 and 16 of the conveyance path 11.

Then, when the tip of the roll paper R2 reaches the pair of conveyance rollers 15 and 16 inside the conveyance path 11 (step S3: Yes), at step S4, the control unit 60 drives the conveyance motor 71. The pair of conveyance rollers 15 and 16 are rotated by the driving of the conveyance motor 71, and the tip of the roll paper R2 is pulled to the recording head 13 side. Also, the roll paper R2 is sandwiched respectively from the top and bottom by the pair of conveyance rollers 15 and 16.

At step S5, the control unit 60 drives the movability motor 73, and switches the position of the driven roller 53 of the pair of paper feed rollers. The movable mechanism 55 is moved by the rotation of the movability motor 73, and the position of the driven roller 53 is changed to the second position (FIG. 1B). By the driven roller 53 being at a position separated from the roll paper R2, the abutting of the pair of paper feed rollers 52 and 53 on the roll paper R2 is released.

Figure 6:
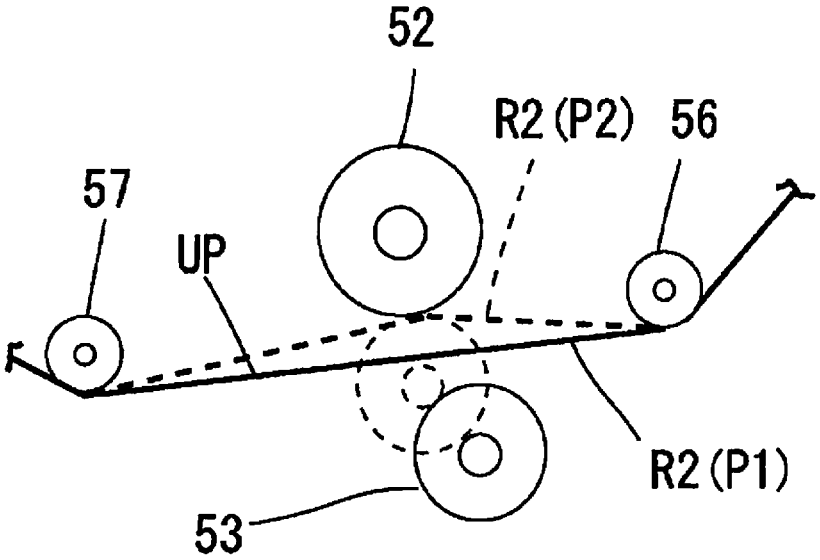
FIG. 6 is a drawing for explaining the changes in the roll paper path of the first position and the second position.

FIG. 6 is a drawing for describing changes in the roll paper path with the first position and the second position. As shown in FIG. 6, in a state with the abutting by the pair of paper feed rollers 52 and 53 released, the position of the roll paper R2 positioned in the second paper feed path 40 (P1) differs from the position when abutting the pair of paper feed rollers 52 and 53 (P2). In FIG. 6, by the top surface UP of the roll paper R2 abutting and being supported (stretched) respectively by the first support roller 56 and the second support roller 57, the position of the roll paper R2 is changed.

As a result, since the pair of paper feed rollers 52 and 53 are not abutting the roll paper R2, when the recording head 13 performs recording, or when the pair of conveyance rollers 15 and 16 convey the roll paper R2 in the conveyance path 11, the roll paper R2 is not put in an unreasonable orientation or damaged.

In particular, by the roll paper R2 being supported (stretched) at two points by the first support roller 56 and the second support roller 57, the path of the roll paper R2 positioned in the second paper feed path 40 becomes a position at which the drive roller 52 and the driven roller 53 are separated and not in contact, and it is possible to suppress the effect due to friction that occurs by contact of the pair of paper feed rollers 52 and 53.

Then, returning to FIG. 5, at step S6, the control unit 60 drives the recording head 13, and recording is performed on the roll paper R2. Specifically, while the pair of conveyance rollers (15, 16) sandwiches the roll paper R2, the tip of the roll paper R2 is conveyed onto the platen 14. Then, the control unit 60 moves the recording head 13 back and forth in the main scan direction based on job data recorded in the non-volatile memory 64, and records ink on the roll paper R2.

At step S7, the control unit 60 determines whether or not the printing process has ended. Here, since the printing of the final raster data of the recording image included in the job data has not ended (step S7: No), the process returns to step S6, and the conveyance of the roll paper R2 by the pair of conveyance rollers 15 and 16 and recording by the recording head 13 are continued. On the other hand, when the printing of the final raster data of the recording image has ended (step S7: Yes), at step S8, the control unit 60 drives the cutter 18 and cuts the roll paper S2. Because of that, the tip of the cut roll paper S2 is ejected by its own weight, and is housed in stacker 19.

Then, at step S9, the control unit 60 stops driving of the conveyance motor 71. Also, at step S10, the control unit 60 drives the movability motor 73, and drives the movable mechanism 55 so that the driven roller 53 is positioned at the first position.

As described above, with this first embodiment, during paper feeding of the roll paper by the pair of paper feed rollers, the movable mechanism holds the pair of paper feed rollers at a position sandwiching the roll paper. Meanwhile, when the movable mechanism releases abutting of the roll paper by the pair of paper feed rollers, the roll paper is supported on the support rollers and is conveyed within the path. Here, by the pulled tip side of the roll paper supported in a state rolled in roll form being supported by the support rollers, the position within the roll paper path changes, and the abutting with the pair of paper feed rollers is eased.

Because of that, even when recording is performed on the roll paper, and it is conveyed, there is no putting the roll paper in an unreasonable orientation or having force applied, and it is possible to do suitable recording.

Also, by the pair of conveyance rollers sandwiching the roll paper, the roll paper is reliably aligned during conveyance, and it is possible to perform recording with good precision.

Also, when conveyance of the roll paper by the pair of conveyance rollers is started, by releasing abutting of the pair of paper feed rollers on the roll paper, it is possible to inhibit forcing of an unreasonable orientation as well as application of unreasonable force on the roll paper due to interference between the sandwiching of the pair of conveyance rollers and the abutting of the pair of paper feed rollers.

Then, during recording on the roll paper, by the movable mechanism releasing abutting of the paper feed rollers on the roll paper, it is possible to ease the effect by the pair of paper feed rollers during recording.

2. Second Embodiment

It is also possible to constitute this such that both the drive roller and driven roller constituting the pair of paper feed rollers are sheltered by the movable mechanism. By using this kind of constitution, regardless of the position of the support rollers 56 and 57, during conveyance by the pair of conveyance rollers 15 and 16, it is possible to reliably separate roll paper from the pair of conveyance rollers 15 and 16. Because of that, it is possible to perform design of the paper feed path with more flexibility.

3. Other Embodiments

The present invention can also have various modification examples.

The use of the pair of rollers as the conveyance unit is merely an example. For example, it is also possible to constitute the conveyance means in any form as long as it is capable of conveying a medium.

Also, in addition to being a device that switches a plurality of media to be recorded and performs recording, the recording device can also be a device that performs recording on one recording medium.

Also, using an inkjet printer as the recording device is merely an example. The recording device can be another printer such as a laser printer or the like, or a combination machine such as a fax machine or the like.

Also, it is also possible to implement constitutions for which the constitutions disclosed in the embodiments and modification examples described above are mutually exchanged, combined, or modified, constitutions for which known technology as well as the constitutions disclosed in the embodiments and modification examples described above are mutually exchanged, combined, or modified, and the like. The present invention includes these constitutions and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a recording unit configured and arranged to perform recording on a recording medium with the recording medium being stored in a rolled state and unrolled from one end;

a first abutting roller and a second abutting roller arranged on an upstream side of the recording unit, the first abutting roller and the second abutting roller facing each other, and configured and arranged to convey the recording medium while the recording medium is nipped between the first abutting roller and the second abutting roller;

a first support roller arranged on a downstream side of the first abutting roller and the second abutting roller in a conveyance path along which the recording medium is conveyed and a second support roller arranged on an upstream side of the first abutting roller and the second abutting roller in the conveyance path, the first support roller and the second support roller being configured and arranged to abut the recording medium to support the recording medium; and a movable mechanism configured and arranged to change a position of the first abutting roller to switch between an abutting state in which both of the first abutting roller and the second abutting roller abut the recording medium and a released state in which the first abutting roller does not abut the recording medium and the second abutting roller does not abut the recording medium, the first support roller and the second support roller being further configured and arranged to support the recording medium such that the second abutting roller does not abut the recording medium when the first abutting roller does not abut the recording medium by changing the position of the first abutting roller with the movable mechanism.

2. The recording device according to claim 1, further comprising a pair of nipping rollers arranged on the downstream side of the first abutting roller and the second abutting roller in the conveyance path, wherein the pair of nipping rollers is configured and arranged to nip the recording medium therebetween to convey the recording medium.

3. The recording device according to claim 2, wherein the movable mechanism is configured and arranged to switch to the released state when the pair of nipping rollers starts conveying the recording medium.

4. The recording device of claim 1, wherein the movable mechanism is configured and arranged to switch to the released state during recording by the recording unit on the recording medium.

5. The recording device of claim 1, wherein a position of the recording medium in a case in which the first abutting roller and the second abutting roller are in the abutting state is different from a position of the recording medium in a case in which the first abutting roller and the second abutting roller are in the released state.

* * * * *